US005091958A

United States Patent [19]

Sakamoto et al.

[11] Patent Number: 5,091,958

[45] Date of Patent: Feb. 25, 1992

[54] WIRING STRUCTURE OF LOUDSPEAKER

[75] Inventors: Yoshio Sakamoto; Shiro Iwakura, both of Tokyo, Japan

[73] Assignee: Kabushiki Kaisha Kenwood, Tokyo, Japan

[21] Appl. No.: 462,765

[22] Filed: Jan. 10, 1990

[30] Foreign Application Priority Data

Apr. 19, 1989 [JP] Japan ..... 1-45072[U]
May 30, 1989 [JP] Japan ..... 1-61910[U]

[51] Int. Cl.[5] ..... H04R 25/00; H01R 9/00; H01R 9/07; H01R 4/10

[52] U.S. Cl. ..... 381/150; 381/182; 381/192; 381/193; 381/194; 29/845; 439/492; 439/879

[58] Field of Search ..... 29/844, 845; 174/94 R; 181/157, 166, 171, 172; 381/150, 153, 158, 193, 194, 197, 199, 182, 192; 439/44, 45, 46, 47, 48, 49, 50, 492, 493, 877, 878, 879, 880, 881, 882, 908; 398/406

[56] References Cited

U.S. PATENT DOCUMENTS 2,221,068 11/1940 Alons ..... 381/197
2,918,649 12/1959 Staley ..... 439/879
3,197,729 7/1965 Sarazen ..... 439/492
4,531,608 7/1985 Heinz ..... 381/193
4,565,905 1/1986 Nation ..... 381/193
4,570,338 2/1986 Ignatowicz ..... 29/845
4,672,675 6/1987 Powell et al. ..... 381/182

FOREIGN PATENT DOCUMENTS 0638080 5/1950 United Kingdom ..... 381/197

*Primary Examiner*—James L. Dwyer
*Assistant Examiner*—William D. Cumming
*Attorney, Agent, or Firm*—Sixbey, Friedman, Leedom & Ferguson

[57] ABSTRACT

A wiring structure of a loudspeaker having a signal input path to a voice coil, the path being established by electrically interconnecting a conductor and an input terminal mounted on a frame, and the conductor being disposed, on a damper having corrugations of concentric circles, along the corrugations from the inner to outer periphery thereof, includes a projection mounted on the damper extending from the outer periphery of the damper to a substrate of the input terminal, the end of the conductor being extended on and along the projection, whereby the end portion of the conductor is connected to a lug on the substrate of the input terminal.

5 Claims, 4 Drawing Sheets

WIRING STRUCTURE OF LOUDSPEAKER

BACKGROUND OF THE INVENTION

1. Field of the Invention

The present invention relates to a wiring structure of a loudspeaker with conductors mounted on the damper for the connection to the voice coil, and particularly to such a wiring structure having an improved coupling means between the end portion of the conductor at the outer peripheral portion of the damper and an input terminal mounted on the speaker frame.

2. Related Background Art

Conventional loudspeaker wiring structures are shown in FIGS. 1, 2A and 2B. A damper 1 for holding a voice coil 5 at the midpoint of a magnetic gap 6 is generally made of woven fabric, unwoven fabric or the like which is molded in a predetermined form after impregnating therein thermosetting rein such as phenol resin and forming thereon corrugations 11 of concentric circles. An electrical path for input signals to the voice coil 5 is established as in the following. Namely, conductors 2 such as copper foil are attached with adhesive agent or the like on the front or back surface of the damper 1. The lead 51 of the conductor 2 on the inner periphery side of the damper is connected to the voice coil 5, whereas the outer end portion 21 of the conductor 2 is connected to an input terminal 4 mounted on the speaker frame 7.

In the wiring structure shown in FIG. 1, the end 21 of the conductor 2 extends beyond the damper outer periphery 12, the end being maintained in a free state. The end 23 of this free portion 22 is coupled to the end portion 31 of a lug 3 of the input terminal 4 by means of solder H. Another coupling structure between the end portion 21 of the conductor 2 and the input terminal 4 is shown in FIGS. 2A and 2B. In this structure, the end 21 of the conductor 2 is flush with the damper outer periphery such that the end portion 31 of the lug 3 is coupled to the end 21 of the conductor by means of solder H as shown in FIG. 2B.

With the structure shown in FIG. 1, in connecting the end portion 31 of the lug 3 to the end of the free portion 22 extending from the end 21 of the conductor 2, it is necessary first to fix the end of the free portion 22 to the end portion 31 of the lug 3, and then solder them together. It is thus very difficult to realize an automatic operation of such soldering.

With the structure shown in FIGS. 2A and 2B, it is also difficult to stably make the end 21 of the conductor which is in flush with the outer periphery 12 of the damper, in contact with the lug 3, because the outer periphery 12 has essentially the nature of being warped. It is thus difficult to ensure an automatic soldering.

Further, the cut section 12*a* of the insulating fabric is present, as shown in the enlarged view of FIG. 2B, between the two soldered points of the conductor 2 mounted on the damper 1 and the end 31 of the lug 3 below the damper position. Therefore, such soldering may often result in a so-called "heap soldering" with considerably poor coupling stability, to thus unable to improve the product quality.

Furthermore, with the conventional wiring structures using the lug 3, the number of necessary components as described above is large, resulting in a difficulty of product cost reduction.

SUMMARY OF THE INVENTION

It is an object of the present invention to provide a wiring structure of a loudspeaker capable of allowing an automatic wiring operation while retaining a stable product quality.

It is another object of the present invention to provide a wiring structure for the conductor on a damper capable of allowing an automatic wiring to the end portion of the conductor, while reducing the number of components and with easy wiring operation and considerably reduced cost.

According to one aspect of the present invention, the wiring structure of a loudspeaker having a signal input path to a voice coil, said path being established by electrically interconnecting a conductor and an input terminal mounted on a frame, and said conductor being disposed, on a damper having corrugations of concentric circles, along said corrugations from the inner to outer periphery thereof, comprises:

a projection mounted on said damper extending from the outer periphery of said damper to a substrate of said input terminal, the end of said conductor being extended on and along said projection, whereby the end portion of said conductor is electrically connected to a lug on said substrate of said input terminal.

In coupling together the end portion of the conductor and the lug, an extruded portion of the lug is bent or pressed down to fixedly connect the lug to the substrate while leaving a fraction of the extruded portion standing upright from the substrate, whereby the upright fraction of the extruded portion is coupled to the conductor.

According to another aspect of the present invention, in a wiring structure for the connection between the end portion of a conductor disposed on a damper and an input lead wire, a lug is mounted on a frame such that one end portion of the lug is formed with an upright portion such as a bending portion or projecting portion, and the other end portion is connected to said input lead wire, whereby the upright portion and the end portion of said conductor are connected together.

The other objects and advantages of the present invention will become apparent from the following detailed description when read in conjunction with the accompanying drawings.

DETAILED DESCRIPTION OF THE PREFERRED EMBODIMENTS

Figure 1:
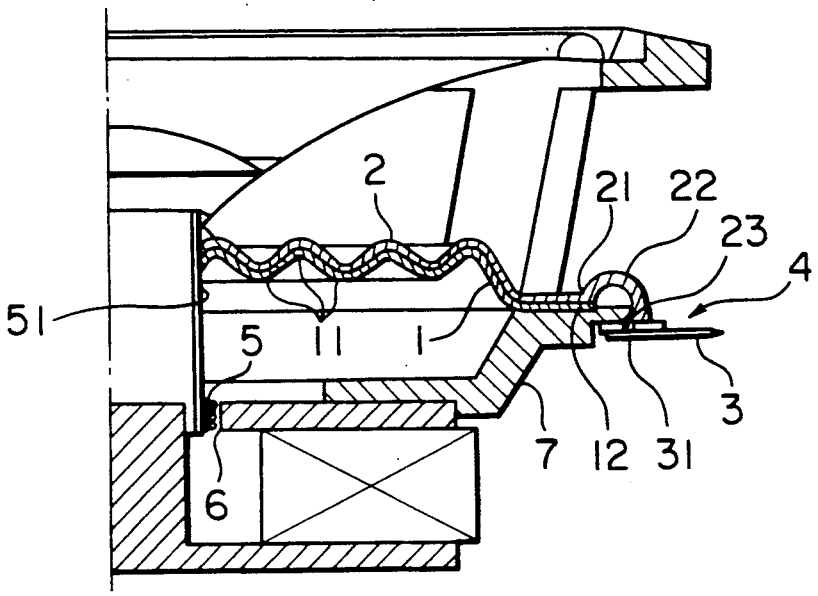
FIG. 1 (PRIOR ART)
FIG. 1 and FIGS. 2A and 2B show the conventional wiring structures of loudspeakers.
Figure 2A:
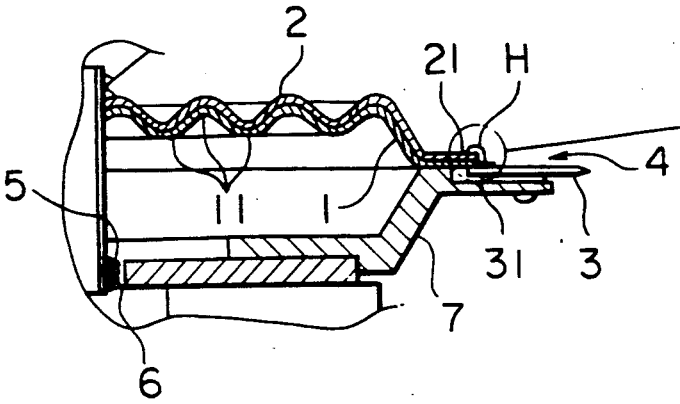
FIG. 2A (PRIOR ART)
Figure 2B:
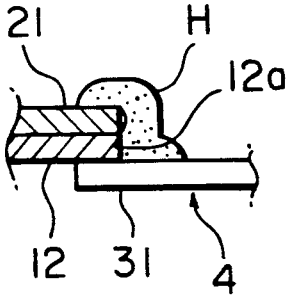
FIG. 2B (PRIOR ART)

Preferred embodiments of the wiring structure of a loudspeaker according to this invention will be described with reference to FIGS. 3 to 10. Like elements to those shown in FIGS. 1, 2A and 2B are represented by identical reference numerals, and the detailed description therefore is omitted.

Figure 3:
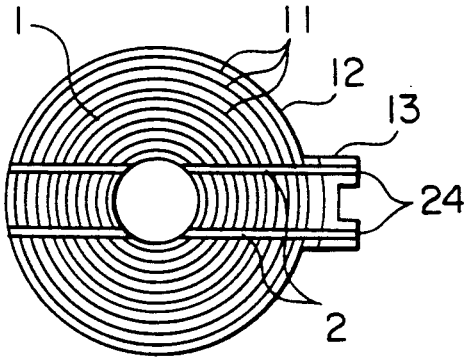
FIGS. 3 to 10 show the wiring structures of loudspeakers according to the embodiments of this invention, wherein there is provided an upright fraction of a lug, the upright fraction erecting by right angles from the substrate of an input terminal.

A damper raw material made of woven fabric or unwoven fabric is impregnated with thermosetting resin such as phenol resin diluted with solvent. After removing the resin tackiness by evaporating the solvent, two tinsel cords woven flat and serving as conductors 2 are sewn in parallel into the damper raw material. In this condition, the assembly is subjected to a heat forming step to obtain a finished damper 1 having corrugations 11 of concentric circles and a projection 13 integrally formed at the outer periphery of the damper, as shown in FIG. 3. As will be later described, the projection 13 extends to a substrate 41 of an input terminal 4 mounted on a speaker frame. The conductor 2 is attached on the projection 13 and its end 24 is flush with the distal end of the projection 13.

Figures 4A, 4B:
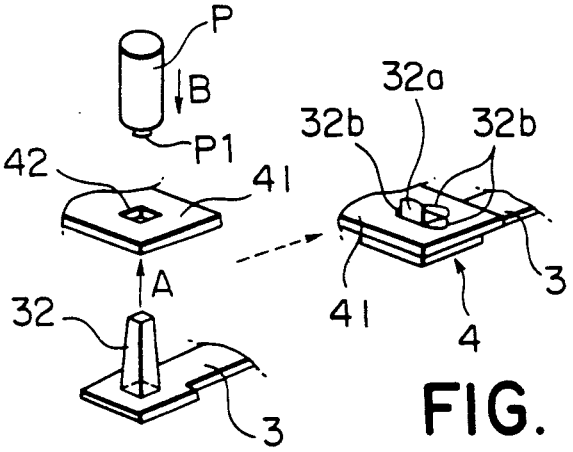

As shown in FIGS. 4A and 4B, the input terminal 4 is constructed such that a lug 3 is mounted on the substrate 41 made of such as fibers, by inserting an extruded portion 32 of the lug 3 formed through a drawing or the like process into a hole 42 of the substrate 41 in the direction represented by an arrow A and by moving downward a punch P mounted on a press in the direction represented by an arrow B to thereby bend and press down the extruded portion 32. By properly selecting the shape of the tip P1 of the punch P, the extruded portion 32 can be bent and pressed down while leaving a fraction thereof without being bent and pressed down Consequently, the fraction 32*a* of the extruded portion extends upright from the substrate 41, whereas the other extruded portion 32*b* are bent and pressed down against the substrate 41.

Figure 5A:
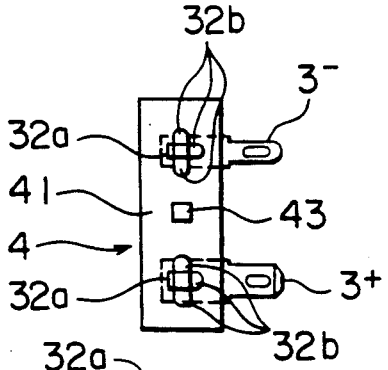
Figure 5B:
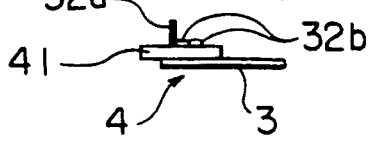
Figure 6:
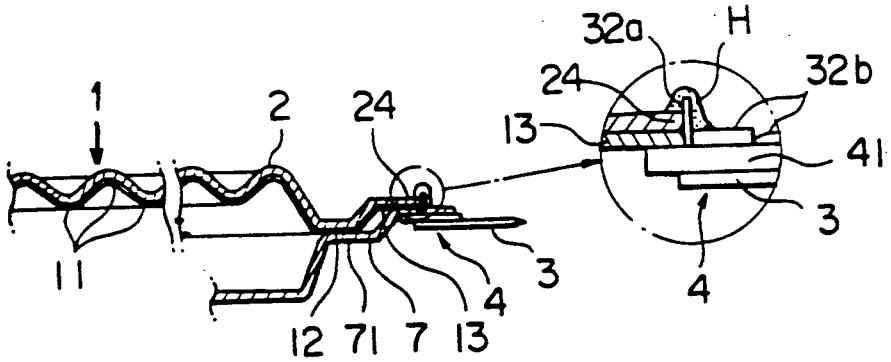
Figure 7A:
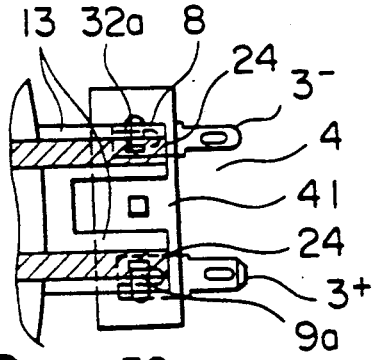
Figure 7B:
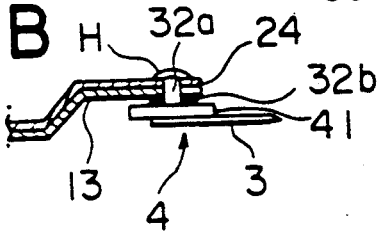
Figure 8:
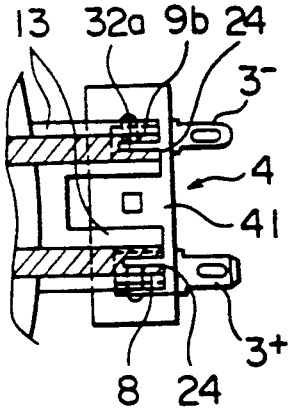

Two lugs 3 for plus side and minus side are mounted on the substrate 41 in the manner described above to thereby obtain the substrate 41 with two lugs 3 as shown in FIGS. 5A and 5B. The substrate 41 is then mounted on a speaker frame 7 via a coupling hole 43 by using a screw or any other suitable fastening means, as shown in FIG. 6. Thereafter, the damper 1 is mounted on the frame 7 at the predetermined position and the outer periphery 12 portion of the damper is attached to a damper seat 71 of the frame 7. In this condition, since the projection 13 extends to the upright fraction 32*a*, the end 24 of the conductor 2 becomes in contact with the upright fraction 32*a*. This contact between the end 24 and the upright fraction 32*a* is soldered for the wiring.

shown in FIG. 4A and FIG. 4B, terminal lugs 3 for plus side 3+ and minus side 3− are fixed to the terminal substrate 41 in the aforementioned manner. This assemble is mounted to the frame 7 with a square eyelet, screw or the like through the mounting hole 43. Subsequently, the damper 1 in the aforementioned configuration is positioned by sticking the outer periphery of the damper to the damper pedestal 71 of the frame 7. As a result, the projection 13 extends to the extruded portion 32*a* and thus the end 24 of the conductor 2 contacts with the extruded portion 32*a*. Accordingly, the wiring work is achieved by soldering the contacting portions.

In the example shown in FIG. 6, the outer periphery of the projection 13, i.e., the end 24 of the conductor, abuts against the upright fraction 32*a*. In the other examples shown in FIGS. 7A, 7B and 8, an engaging section 8 such as holes 9*a* (FIG. 7A) or recesses 9*b* (FIG. 8) is formed in the projection 13 and in the conductor end 24 portion. The upright fraction 32*a* is inserted in the engaging section 8 so that the contact area between the conductor end 24 portion and the upright fraction 32*a* is increased to thereby improve the reliability of soldering. Any desired shape and position of the upright fraction 32*a* and engaging section 8 may be used.

Figure 9:
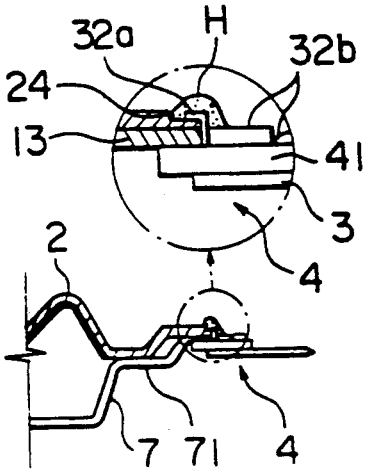

In the example shown in FIG. 9, the upright fraction 32*a* is bent for the connection to the end portion 24 of the conductor 24. Although the electrical connection can be attained in this state, soldering may also be carried out at the contact point.

Figure 10:
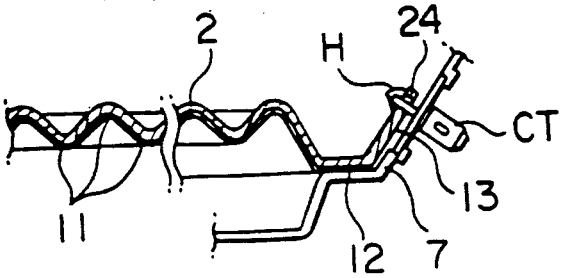

The example shown in FIG. 10 illustrates an application to a dedicated input terminal CT for a mobile loudspeaker.

In the wiring structures of loudspeakers according to the above embodiments, there is mounted a projection at the outer periphery of the damper, the projection extending to the substrate of the input terminal mounted on the frame. Since the conductors are fixedly attached to the projection, position alignment of the conductor end portion with the lug can be easily carried out to thereby allow an automatic wiring and soldering.

In addition, the upright fraction of the extruded portion of the lug extending from the substrate is coupled to the conductor end or end portion. Therefore, the dimension error which otherwise might have been caused, can be eliminated to thus allow an easy and reliable contact between the conductor end or end portion and the lug. Furthermore, soldering is carried out directly between the conductor and the lug without overriding the insulating material at the damper outer periphery, to thereby ensure a very stable soldering.

In the embodiments shown in FIGS. 11 to 14, the lug 3 is mounted directly on a damper rest 51 of the frame 7 which is made of synthetic resin. Outsert molding is used with the embodiments. One end portion of the lug 3 is bent to form an upright fraction 31V. The upright portion 31V is soldered to the end portion of the flat-wound tinsel cord 2 which extends from the attachment margin of the damper.

Figure 11:
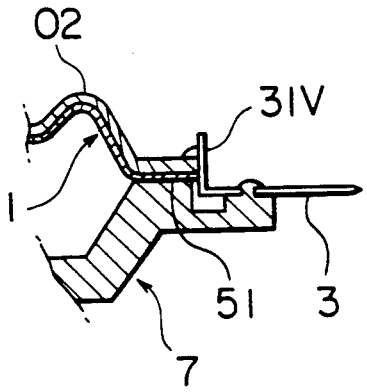
FIGS. 11 to 15 show the wiring structures of loudspeakers according to other embodiments of this invention, wherein there is provided an upright portion formed by bending a part of the lug.

In connecting the end of the flat-wound tinsel cord 2 to the upright portion 31V, soldering in the embodiment shown in FIG. 11 is carried out while making the end of the flat wound tinsel cord 2 in abutment with the upright portion 31V. In the embodiments shown in FIGS. 12 to 14, there is provided an insertion section such as holes or recesses formed near the end of the flat-wound tinsel cord 2 and at a distance from the attachment margin. The upright portion 31V of the lug 3 is inserted into the insertion section for the soldering. This structure allows a more easy alignment of the end portion of the flat-wound tinsel cord 2 with the upright portion 31V of the lug 3.

If the shape of the upright portion of the lug is made different between the plus and minus sides and the shape of the insertion section is made correspondingly different, the plus/minus polarity can be easily discriminated so that erroneous connections during the wiring processes can be avoided among the voice coil 5, flat-wound tinsel cord 2 and lug 3.

Figure 12:
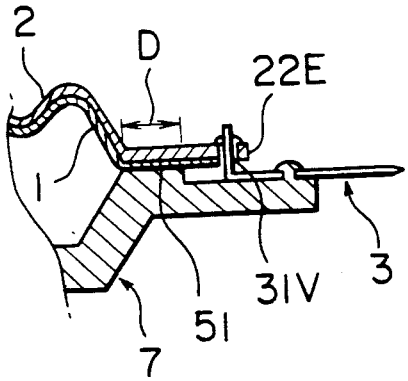

In the embodiment shown in FIG. 12, a part or the whole of the outer periphery of the damper 1 is made diametrically larger than the attachment margin D on the damper rest 51 of the frame 7, so that soldering is carried out at a distance from the damper rest.

Figure 13:
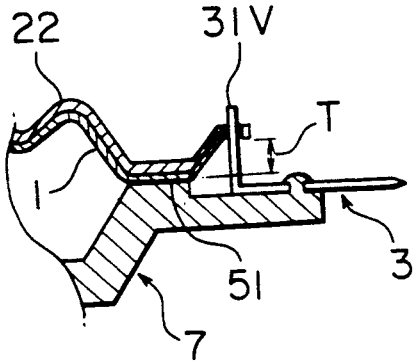
Figure 14:
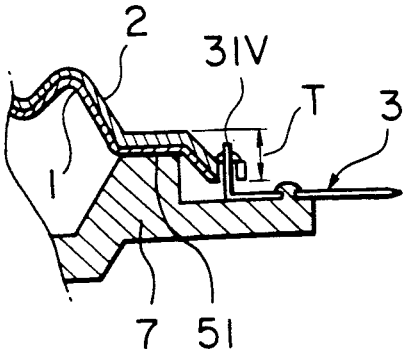

In the embodiments shown in FIGS. 13 and 14, the outer peripheral portion of the damper 1 is molded extending from the attachment margin of the damper upward (FIG. 13) or downward (FIG. 14) by a distance (T). Soldering is therefore carried out at the position different in height from the damper rest 51. With this structure, adhesive agent on the attachment margin of the damper will not flow toward the soldering point, thereby simplifying the soldering work.

In the above-described structures, if the lug 3 is mounted so that the upright portion 31V thereof is positioned inside of the inner periphery of a mount of a diaphragm suspension (edge) as shown in FIG. 11, the damper 1 can be mounted from the upper position as viewed in FIG. 11 to the predetermined position by using an automatic inserter, thereby effectively reducing man power in assembling the structure.

The upright portion 31V of the lug 3 and the end or end portion of the conductor are soldered together as described above. A coupling lug mounted at the tip of the input lead wire is inserted into a lug hole formed at the other end thereof and electrically connected thereto, in a similar manner as conventional.

Figure 15:
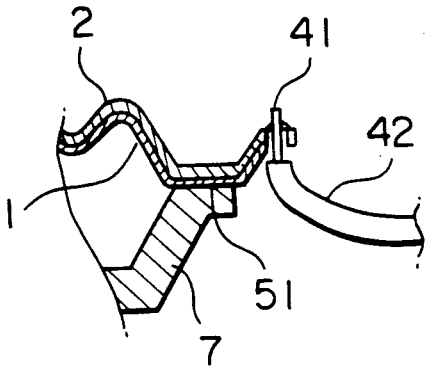

In the above embodiments, the wiring between the lug 3 and the flat-wound tinsel cord 2 has been described. The tip 41 of the input lead wire may be inserted into the above-described insertion section to directly solder it to the cord 2 as shown in FIG. 15.

In the above embodiments, the frame made of synthetic resin has been used in order to avoid possible electric short circuits. Conductive metal frames may also be used if the lug is mounted thereon with an insulating material interposed therebetween.

With the wiring structures described above for the connection to the conductor on the damper, the end portion of the conductor is fixedly attached to the damper outer peripheral portion. Consequently, it is easy to align the positions of the conductor and the lug and assembly various components, thus allowing automatic assembly of a loudspeaker and automatic wiring processes, with considerable reduction of man power and improvement of product quality.

Further, a substrate made of fibers, fastening eyelets, small screws and the like are not needed which otherwise have been used in a conventional wiring structure. It is therefore possible to reduce the number of components and product cost.

While the presently preferred embodiments of the present invention have been shown and described, it is to be understood that this disclosure is for the purpose of illustration and that various changes and modifications may be made without departing from the scope of the invention as set forth in the appended claims.

What is claimed is:

1. A wiring structure of a loudspeaker having a signal input path to a voice coil, said path being established by electrically interconnecting a conductor and an input terminal mounted on a frame, and said conductor being disposed, on a damper having corrugations of concentric circles, along said corrugations from the inner to outer periphery thereof, comprising:

a projection mounted on said damper extending from the outer periphery of said damper to a substrate of said input terminal, the end of said conductor being extended on and along said projection, whereby the end portion of said conductor is connected to a lug on said substrate of said input terminal, wherein in coupling together the end of said conductor and said lug, an extruded portion of said lug is bent or pressed down to fixedly connect said lug to said substrate while leaving a fraction of said extruded portion standing upright from said substrate, whereby said upright fraction of said extruded portion is coupled to said conductor.

2. A wiring structure of a loudspeaker according to claim 1, wherein there is formed an engagement section made of a hole or recess in the end portion of said conductor, whereby said upright fraction is engaged with said engagement section to carry out soldering.

3. A wiring structure of a loudspeaker according to claim 1, wherein said upright fraction is bent for the connection to the end portion of said conductor.

4. A wiring structure for the connection between the end portion of a conductor disposed on a damper and an input lead wire, comprising:

a lug mounted on a frame such that one end portion of the lug is formed with an upright portion such as a bending portion or projecting portion, and the other end portion is connected to said input lead wire, whereby the upright portion and the end portion of said conductor are connected together, and wherein a part of the outer periphery of said damper is made diametrically larger than a damper rest, whereby the outer end portion of said conductor on said damper is connected to said lug at a distance from said damper rest.

5. A wiring structure for the conductor on the damper according to claim 4, wherein a part of the whole or the outer periphery of said damper extends further outwardly from an attachment margin of said damper on said damper rest, the extended portion being directed upward or downward relative to said damper rest, whereby the outer end portion of said conductor on said extended portion is connected to said lug at the position different in height from said damper rest.

* * * * *